United States Patent [19]

Asaka et al.

[11] 4,336,864

[45] Jun. 29, 1982

[54] SILENCER FOR AN INTERNAL COMBUSTION ENGINE

[75] Inventors: Urataro Asaka, Kamifukuoka; Naomoto Uesugi, Tokyo; Nobuo Anno, Urawa, all of Japan

[73] Assignee: Honda Giken Kogyo Kabushiki Kaisha, Tokyo, Japan

[21] Appl. No.: 215,436

[22] Filed: Dec. 11, 1980

[30] Foreign Application Priority Data

| | | | |
|---|---|---|---|
| Dec. 13, 1979 | [JP] | Japan | 54-160856 |
| Feb. 14, 1980 | [JP] | Japan | 55-16475[U] |
| Feb. 15, 1980 | [JP] | Japan | 55-17154[U] |

[51] Int. Cl.[3] ..... F01N 7/00; F01N 1/08

[52] U.S. Cl. ..... 181/241; 181/255

[58] Field of Search ..... 181/241, 249, 255, 271

[56] References Cited

U.S. PATENT DOCUMENTS 2,214,894 9/1940 Wilson ..... 181/241 X

FOREIGN PATENT DOCUMENTS 48-16223 2/1973 Japan .

*Primary Examiner*—Richard A. Wintercorn
*Assistant Examiner*—Thomas H. Tarcza
*Attorney, Agent, or Firm*—Armstrong, Nikaido, Marmelstein & Kubovcik

[57] ABSTRACT

A silencer for an internal combustion engine includes a main silencer having an axially movable tubular member located therein which is movable from a first position in which it constitutes an extension of an inlet to the main silencer and a second position in which it is spaced from the inlet for exhaust gases entering the silencer, thus permitting the exhaust gases to flow directly into the main silencer.

5 Claims, 11 Drawing Figures

SILENCER FOR AN INTERNAL COMBUSTION ENGINE

FIELD OF THE INVENTION

This invention relates to a silencer for an internal combustion engine, and, in particular relates to a silencer which is adjustable in characteristics for it to accommodate the varying flow rate and other parameters of gases exhausted from said engine when said engine is operating at a high speed or at a low speed.

BACKGROUND OF THE INVENTION

A silencer which operates satisfactorily at a low speed of the engine, when the flow rate of the gases is comparatively small and pulsations in the gas flow are relatively large, does not operate at maximum efficiency at the time the speed of the engine is increased, when the flow rate of the gases exhausting from the engine becomes comparatively large, and the magnitude of the pulsations in the gas flow become relatively smaller.

Various proposals have been made to increase the operating efficiency of such silencers over the entire range of engine speeds, but, those attempts have largely involved a compromise between the various parameters involved, in that they employ structures which are fixed relatively to each other, and which are thus incapable of varying in position in dependence on the engine speed and the characteristics of the exhaust gas flow therefrom.

It has been proposed to provide a silencer in which a main silencer is movable axially with respect to the inlet thereto in order that the axial length of the inlet conduit may be varied in order to adjust the characteristics of the silencer to the varying parameters of the engine exhaust. Such a structure is, however, cumbersome and difficult to support on a vehicle such as a motorcycle, and, further problems are encountered in accommodating the varying length of the silencer as it moves between an extended and a retracted position.

INVENTIVE CONCEPT

According to the present application, a silencer is provided in which elements of the silencer are movable relatively to each other in order to accommodate the varying parameters of the exhaust gas flow. The movable elements of the silencer are contained entirely within a main silencer which is fixed in position relatively to a supporting structure therefor and relatively to an inlet to the silencer for exhaust gases.

DESCRIPTION OF THE DRAWINGS

The invention will now be described with reference to the accompanying drawings, in which.

DESCRIPTION OF THE PRIOR ART STRUCTURE

Figure 1:
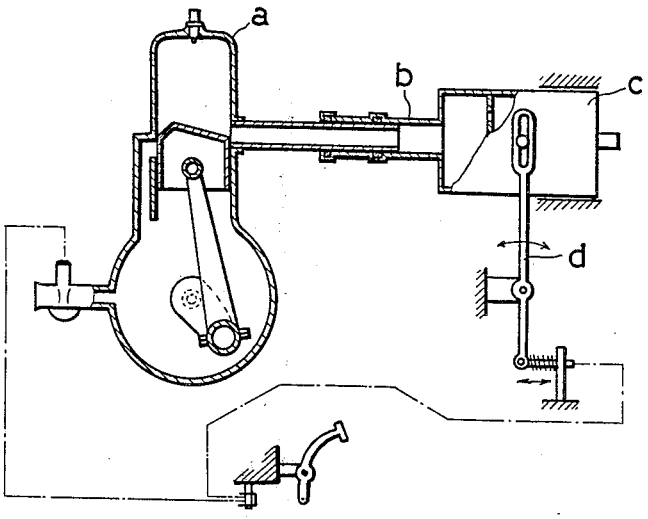
FIG. 1 is a diagrammatic illustration of the prior art form of silencer discussed above, in which the main silencer is movable axially relatively to the inlet thereto.

Referring exclusively to FIG. 1, there is illustrated an internal combustion engine a, having an exhaust duct on which an elongated tubular member b of a silencer is slidably received. The elongated tubular portion b is attached to a main silencer portion c. The tubular portion b and main silencer c are slidable axially of the exhaust duct in order to vary the axial length of the flow path of exhaust gases prior to the exhaust gases reaching the main silencer c. The silencer is movable between an extended and a retracted position by means of a linkage d in any convenient manner, such as by a mechanical linkage with the accelerator, or, a linkage controlled by the crankcase pressure. As is previously discussed, this prior art structure is encumbered with the disadvantages that the silencer is difficult to support from a motor vehicle such as a motorcycle in that provision must be made for the adequate support thereof, while at the same time permitting axial sliding of the silencer between its extended and retracted position. Further, and in particularly in the case of a motorcycle, problems are encountered providing sufficient space in the longitudinal direction to accommodate the movement of the silencer between its respective extended and retracted positions.

DESCRIPTION OF PREFERRED EMBODIMENTS OF THE INVENTION

Figure 2:
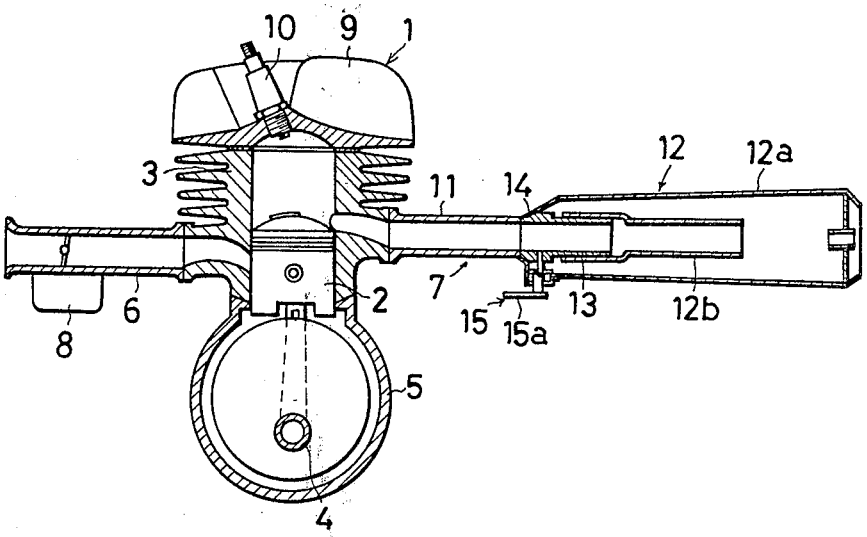
FIG. 2 is a diagrammatic cross section through an internal combustion engine and a silencer according to the present invention.

Referring now to FIG. 2, there is illustrated an internal combustion engine, 1, typically the drive motor of a motorcycle, the internal combustion engine being of conventional construction and including a piston 2 which is reciprocable within a cylinder 3 and drives a crank shaft 4 contained within a crankcase 5. The engine includes the conventional air inlet 6, exhaust duct 7, carburetor 8, cylinder head 9 and spark plug 10, each of which operate in a manner well known in the art.

Figure 3:
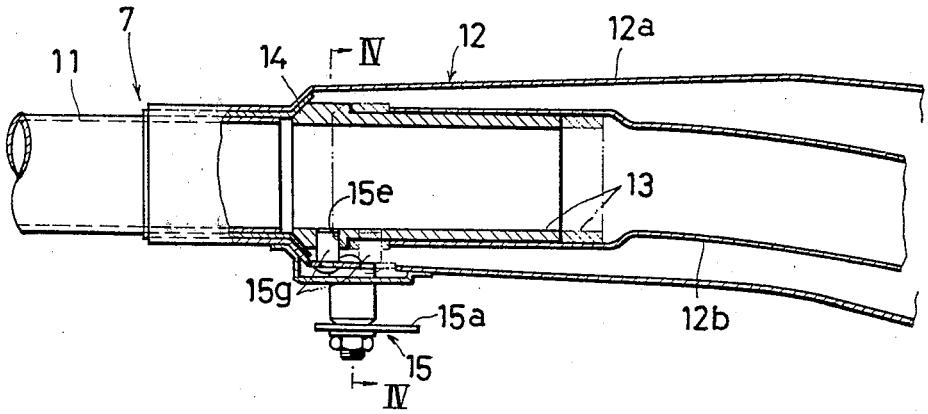
FIG. 3 is an enlarged sectional view of the silencer illustrated in FIG. 2.
Figure 4:
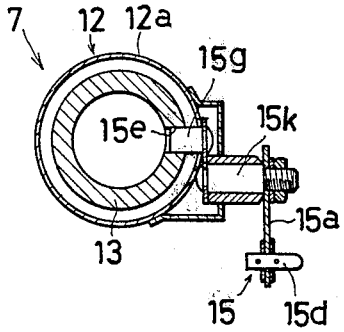
FIG. 4 is a cross section taken along the line IV—IV of FIG. 3.

Referring now additionally to FIGS. 3 and 4, the exhaust duct 7 includes an exhaust pipe 11, to which is rigidly attached a silencer 12 comprised by a main silencer **12*a* and a secondary silencer 12*b* which is located within the main silencer 12*a*, and which is rigidly supported by the main silencer 12*a*** in a manner prohibiting movement of the secondary silencer relatively to the main silencer.

The secondary silencer **12*b* terminates at a position spaced from the connection of the main silencer 12*a* to the pipe 11, and, is of tubular form at its termination in order to provide a sleeve in which a tubular member 13** is supported for axial sliding movement. The sleeve 13, as more clearly illustrated in FIG. 3, includes an enlarged end portion intermediate the end of the secondary silencer and the inlet to the main silencer, the end of the sleeve 13 and the juxtaposed face of the inlet to the main silencer 12*a* being formed as conical seatings, which cooperate when the tubular member is an extended position to prohibit the flow of exhaust gases from the pipe 11 directly into the main silencer 12*a*.

The tubular member 13 is movable in an axial direction from the position shown in full lines in FIG. 3 to the position shown in chain dotted lines in that figure under the control of a linkage 15, which is actuated in dependence on the engine speed as described below. In its retracted position as shown in chain dotted lines, the tubular member 13 is spaced from the seating 14 of the main silencer 12*a*, thus permitting exhaust gases to flow directly into the main silencer 12*a*.

It will be understood that while, in the preferred embodiment, a secondary silencer 12*b* is incorporated into the structure, the tubular member 13 alone may be employed in the absence of the secondary silencer 12*b*, in which case the tubular member 13 would be supported in an appropriate manner directly from the main silencer 12*a*. In such a structure, movement of the tubular member 13 between its extended and its retracted position would serve to vary the effective length of the pipe 11, with a consequential change in the resonant frequency of the pipe 11.

The control 15 includes a lever 15*a*, which is rigidly attached to one end of a shaft journaled for rotation in a member attached to the main silencer 12*a*, the shaft having an off-set pin 15*g* at its opposite end, which is received in an aperture 15*e* in the tubular member 13. By movement of the lever 15*a*, the pin 15*g* is caused to move between the positions shown in full lines and in dotted lines in FIG. 3, thus moving the tubular member 13 between its extended and its retracted positions. The tubular member 13, which is formed from a heatresistant non-oxidizable material, such as a ceramics material, freelyslides within the tubular end of the secondary muffler 12*b* in the absence of lubricants or the like.

Figure 5:
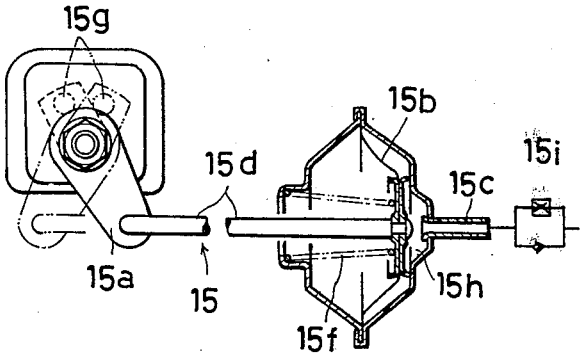
FIG. 5 is a diagrammatic view, partially in cross section, illustrating an actuator for a movable element of the silencer of FIGS. 2, 3 and 4.

In order to provide for the movement of the lever 15*a* in dependence on the speed of operation of the engine, and as is illustrated in FIG. 5, a diaphragm-operated motor is provided, the diaphragm 15*b* of which is linked to the lever 15*a* by a push-rod 15*d*. The diaphragm 15*b* closes a chamber 15*h* which is connected by means of a conduit 15*c* to the crankcase 5 through a pressure surge eliminator 15*i*, the pressure within the engine crankcase, as transmitted to the chamber 15*h*, acting to move the diaphragm 15*b* against the bias of a spring 15*f*. By determining the rate of the spring 15*f*, the pressure at which the diaphragm will move to actuate the lever 15*a*, and thus move the tubular member 13 can be determined, that pressure corresponding with a selected speed of the engine.

Figure 6:
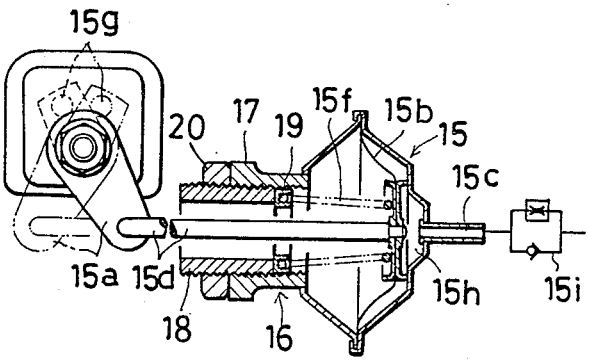
FIG. 6 is a diagrammatic view, partially in section, illustrating a modification of the structure shown in FIG. 5.

In order to provide for adjustment of the pressure at which the diaphragm motor will operate, and thus the speed of the engine which the tubular member 13 will be retracted, an adjustment for the spring rate can be provided, as illustrated in FIG. 6. In FIG. 6 the spring 15*f* reacts at one of its ends on the central support of the diaphragm 15*b*, and, at its other end reacts against a collar 19 which is slidable within the bore of a tubular guide nut 17 under the control of a tubular adjusting screw 18. A nut 20 is provided for locking the tubular adjusting screw 18 in its set position.

While the silencer of the present invention preferably is operated automatically in dependence on the pressure existing in the engine crankcase, it also can be operated in dependence on the extent to which the throttle is open, or in dependence on the actual rotational speed of the engine, or in dependence on the vacuum in the inlet manifold, or, in dependence on the position of an automatic or mechanical transmission, or, in dependence on the position of a pulley in the case of a variable pulley type transmission.

Figure 7:
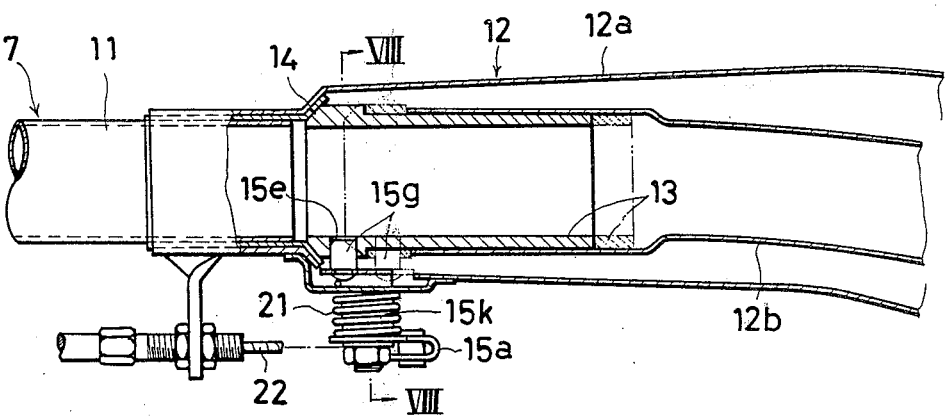
FIG. 7 is a cross sectional view through the silencer according to the present invention showing an alternative form of actuator for a movable element thereof.
Figure 8:
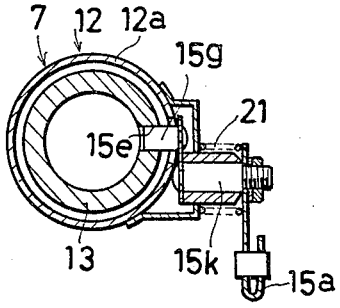
FIG. 8 is a cross section taken on the line VIII—VIII of FIG. 7.
Figure 9:
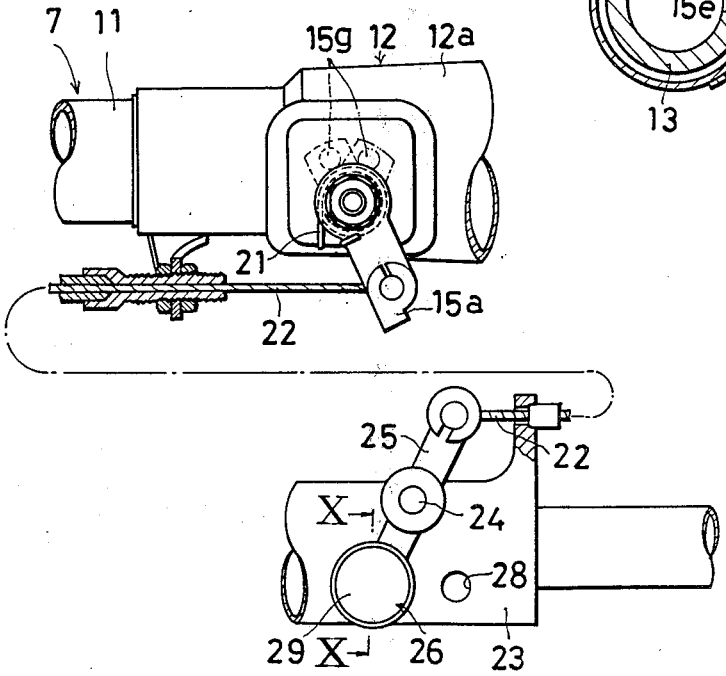
FIG. 9 is a diagrammatic view illustrating a manual actuator for the adjusting mechanism disclosed in FIGS. 7 and 8.
Figure 10:
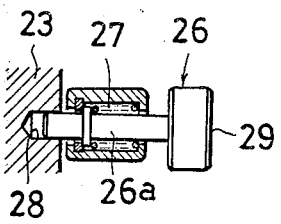
FIG. 10 is a diagrammatic sectional view of an actuator for the structure illustrated in FIGS. 7 to 9; and, FIG. 11 is a diagram illustrating the exhaust flow characteristics of an internal combustion engine at high and low engine speeds and the characteristics of a silencer according to the present invention.

Alternatively, a mechanical actuator for the sleeve 13 can be provided, as shown in FIGS. 7 through 9, in which a spring 21 is coiled around the support 15*k* of the actuator 15, the spring 21 being attached at one of its ends to the main silencer 12*a*, and, at the other of its ends reacting against the lever 15*a* to at all times bias the tubular member 13 to its extended position as illustrated in FIG. 7. The lever 15*a* in this embodiment is attached to one end of a cable 22, such as a flexible Bowden cable, the other end of which is attached to a lever 25, which is pivotally mounted at 24 on a bracket 23 supported on the handle bars of the motorcycle. The lever 25 is provided with a positioning device 26 comprised by a pin 26*a* which is receivable within openings 28 in the bracket 23, the pin 26 being withdrawable from the openings 28 against the bias of a spring 27 by means of a hand-operated knob 29. Upon withdrawal of the pin 26*a* from an opening 28, the lever 25 can be rotated to either pull or release the flexible cable 22, a pull on the cable 22 resulting in retraction of the tubular member 13, and, release of the cable 22 resulting in a return of the tubular member 13 to its extended position under the influence of the spring 21.

Figure 11:
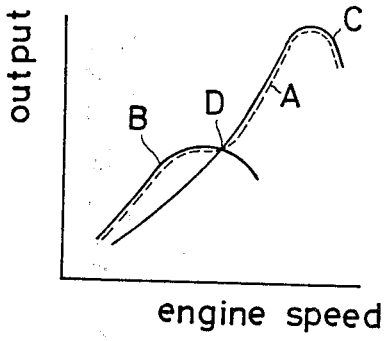

Referring now to FIG. 11, the characteristics of the silencer of the present invention as related to the engine speed and exhaust flow output of the engine are indicated by the dotted line A. As will be noted, the dotted line A closely follows the exhaust flow output characteristics B of the engine when the engine is operating at low speed and the exhaust flow output characteristics C of the engine when the engine is operating at a high speed. Preferably, change-over of the position of the tubular member 13 is effected at the point D, in order that the characteristics of the silencer shall follow the exhaust flow output characteristics of the engine over the entire operational range of speeds thereof.

As will be appreciated, the main silencer may be of any desired form, and preferably is one which progressively increases in diameter from its inlet end to the outlet end thereof. Similarly, the secondary muffler 12*b* may be of any desired form that can be accommodated within the main silencer 12*a*. The aperture 15*e* in the tubular member 13 may be a circular aperture, in which event the tubular member will rotate slightly upon movement between its extended and its retracted position, or, alternatively, the aperture 15*e* can be in the form of a groove or cam-track formed in the tubular member 13. Further, any convenient form of actuator 15 can be employed, and, the diaphragm motor can be replaced by any other convenient form of motor, such as a bellows-actuated motor, or a piston and cylinder arrangement. Further, the control means can include time delays or damping mechanisms in order to avoid unintentional hunting of the tubular member 13. Various other modifications of the actuator 15 are possible, and, such modifications fall within the scope of the appended claims.

What is claimed is:

1. A silencer for an internal combustion engine comprising:

a tubular main silencer having inlet means at one of its axial ends for connection to an exhaust pipe of said engine, an outlet at the other axial end thereof for the exhaust of combustion gases from said engine, a progressively increasing diameter from the inlet means end to the outlet end for accommodating and silencing the exhaust of gases from said engine when said engine is operating in a high speed range, and an annular conical seat interiorly defined at the inlet end;

a tubular secondary silencer entirely positioned interiorly within the main silencer and fixedly supported therein, the secondary silencer having an inlet end and, a substantially constant diameter throughout its length for accommodating and silencing the exhaust of gases from said engine in conjunction said main silencer when said engine is operating in a low speed range;

a tubular member slidably supported within a tubular portion of the inlet end of the secondary silencer and axially movable between a first position in which it receives the entire flow of gases from said engine and directs them totally into the secondary silencer and a second position in which said exhaust gases can pass direct by into said main silencer, said tubular element including an annular conical portion at its end adjacent said inlet means of said main silencer which is sealingly received in said conical seat when said tubular member is in said first position; and means for moving said tubular member between said first and second positions to change the exhaust characteristics of said silencer.

2. The silencer according to claim 1, in which said means for moving the tubular member includes a pressure-operated motor connected to a variable source of pressure of the engine, a linkage interconnecting a movable member of said motor and said tubular member, whereby said movable member moves the tubular member from said first position to said second position upon a rise in pressure available to said motor, and a spring for returning said linkage and said tubular member from said second position to said first position upon a drop in pressure available to said motor.

3. The silencer according to claim 2, in which said pressure operated motor includes a chamber connected to said variable pressure source, and a diaphragm closing said chamber and which is connected to operate said linkage.

4. The silencer according to claim 2, including means to adjust the spring rate of said spring.

5. The silencer according to claim 1, in which said means for moving the tubular member includes a linkage connected to move said tubular member between said first and second positions, a spring urging said linkage to move said tubular member to said first position, a flexible cable connected to said linkage at one of its ends, and a manually operable lever connected to operate the flexible cable at the other of its ends against the bias of said spring for moving said tubular member from said first position to said second position.

* * * * *